US006776855B1

(12) United States Patent
Ueda et al.

(10) Patent No.: US 6,776,855 B1
(45) Date of Patent: Aug. 17, 2004

(54) MARAGING STEEL EXCELLENT IN FATIGUE CHARACTERISTICS AND METHOD FOR PRODUCING THE SAME

(75) Inventors: Masami Ueda, Higashi-Osaka (JP); Kenji Hirano, Suita (JP)

(73) Assignees: Honda Giken Kogyo Kabushiki Kaisha, Tokyo (JP); Sumitomo Special Metals Co., Ltd., Osaka (JP)

( * ) Notice: Subject to any disclaimer, the term of this patent is extended or adjusted under 35 U.S.C. 154(b) by 0 days.

(21) Appl. No.: 09/700,566

(22) PCT Filed: Mar. 15, 2000

(86) PCT No.: PCT/JP00/01587

§ 371 (c)(1),
(2), (4) Date: Nov. 16, 2000

(87) PCT Pub. No.: WO00/56944

PCT Pub. Date: Sep. 28, 2000

(30) Foreign Application Priority Data

| | | |
|---|---|---|
| Mar. 19, 1999 | (JP) | 11-074807 |
| Jun. 24, 1999 | (JP) | 11-178226 |
| Aug. 26, 1999 | (JP) | 11-239146 |

(51) Int. Cl.[7] ..... C22C 38/08; C22C 38/10

(52) U.S. Cl. ..... 148/328; 148/336; 420/126; 420/95; 420/96

(58) Field of Search ..... 148/336, 328; 420/95, 96, 126

(56) References Cited

U.S. PATENT DOCUMENTS 3,532,491 A 10/1970 Floreen et al.

FOREIGN PATENT DOCUMENTS

| | | |
|---|---|---|
| JP | 49-9465 | 1/1974 |
| JP | 59-147746 | 8/1984 |
| JP | 1-142022 | 6/1989 |
| JP | 2-163315 | 6/1990 |
| JP | 6-248389 | 9/1994 |
| JP | 8-269564 | 10/1996 |
| JP | 10-30107 | 2/1998 |
| JP | 10-193038 | 7/1998 |
| JP | 11-293407 | 10/1999 |

OTHER PUBLICATIONS

Recent Developments in Specialized Smelting Technology, Chapter 7, Specialized Melting Techniques by Tamiya Kishida, pp. 207–208, The Iron and Steel Institute of Japan (Nippon Tokko Kyokai Feb. 17, 18, 1981 (72nd Meeting); Mar. 11, 12, 1981 (73rd Meeting).

(List continued on next page.)

*Primary Examiner*—George Wyszomierski
*Assistant Examiner*—Janelle Combs-Morillo
(74) *Attorney, Agent, or Firm*—Jordan and Hamburg LLP

(57) ABSTRACT

The present invention provides a maraging steel excellent in fatigue characteristics and a process for the production thereof.

A maraging steel of the first embodiment of the present invention has a chemical composition consisting essentially of, in % by weight: C: 0.01% or less, Ni: 8–19%, Co: 8–20%, Mo: 2–9%, Ti: 0.1–2%, Al: 0.15% or less, N: 0.003% or less, O: 0.0015% or less, and the balance Fe and the Ti component segregation ratio and the Mo component segregation ratio in its structure of 1.3 or less each. A maraging steel of the second embodiment of the present invention has the above composition and contains a nonmetallic inclusion in its structure having a size of 30 $\mu$m or less. The maraging steel of the second embodiment can be obtained easily by appropriate plastic working of a steel ingot with a taper Tp=(D1−D2)×100/H of 5.0–25.0%, a height-diameter ratio Rh=H/D of 1.0–3.0, and a flatness ratio B=W1/W2 of 1.5 or less. The material and production method of the present invention are suitable for various types of maraging steel members for which excellent fatigue characteristics are required.

2 Claims, 5 Drawing Sheets

OTHER PUBLICATIONS

Transactions of the Metallurgical Society of AIME, "The Origin and Significance of Banding in 18NI (250) Maraging Steel " by P.H. Salmon Cox, B.G. Reisdorf, and G.E. Pellissier, vol. 239, Nov. 1967, pp. 1809–1817.

Notice of Revocation of the Japanese Patent No. 3110733, Publication Date: Jul. 31, 2001.

Notice of Revocation of the Japanese Patent No. 3110726, Publication Date: Jul. 31, 2001.

MARAGING STEEL EXCELLENT IN FATIGUE CHARACTERISTICS AND METHOD FOR PRODUCING THE SAME

TECHNICAL FIELD

The present invention relates to a maraging steel with excellent fatigue characteristics and a method for producing the same.

BACKGROUND ART

Maraging steel is ultralow carbon-Ni steel or ultralow carbon-Ni-Co steel. It is a steel strengthened by precipitating intermetallic compounds of Ti or Mo, etc. on a matrix of tough martensite. It is tough and high in strength. It also possesses many other advantages not previously available such as good weldability and little change in dimensions by heat treatment. Therefore, maraging steel is used as a structural material in leading-edge technical fields such as space development, ocean development, atomic energy utilization, aircraft, and automobiles. Attempts are also being made to put it to use for a wide range of purposes in diverse fields such as pressure-proof vessels, tools, piston rams, and dies.

However, maraging steel poses the following problems due to its high strength and mechanism of strengthening. Specifically, sensitivity to nonmetallic inclusions in the material increases as the strength rises. The concentration of stress by these inclusions lowers the fatigue strength and tends to create inferior durability.

Therefore, improvement of the fatigue characteristics has been attempted to resolve such problems by melting by vacuum induction melting (VIM), then remelting by vacuum arc remelting (VAR) to raise the degree of cleanness of nonmetallic inclusions by controlled reduction of N and O and thereby to reduce the number of nonmetallic inclusions that serve as the origin of fatigue rupture.

The above technology improved the durability to a certain extent. However, the conditions of use of machinery and constructs have become more rigorous in recent years and demands on the strength characteristics of materials have become increasingly severe.

Further improvement of the durability is also demanded to assure the long-term stability of machinery and constructs. This has led to a demand for the development of maraging steel with superior fatigue characteristics for the construction of machinery. Another problem with the conventional production process was the low productivity and the need for expensive, special vacuum arc remelting equipment since vacuum arc remelting was conducted after vacuum induction melting.

The present invention takes note of these problems and has as its object to propose maraging steel with excellent fatigue characteristics and a production process that makes it possible to manufacture the aforementioned maraging steel easily without vacuum arc remelting. This goal is attained by the present invention described below.

DISCLOSURE OF THE INVENTION

The maraging steel of the present invention has a chemical composition consisting essentially of, in % by weight:

C: 0.01% or less,

Ni: 8–19%,

Co: 8–20%,

Mo: 2–9%,

Ti: 0.1–2%,

Al: 0.15% or less,

N: 0.003% or less,

O: 0.0015% or less.

and the balance Fe and the Ti component segregation ratio and the Mo component segregation ratio in its structure of 1.3 or less each.

The maraging steel of the present invention can suppress the production of nonmetallic inclusions without vacuum arc remelting because it is formed steel with limited N and O contents and components that make it difficult for nonmetallic inclusions to be produced. The maraging steel of the present invention can also suppress the production of a band structure caused by segregation of the components because the Ti component segregation ratio and the Mo component segregation ratio are 1.3 or less each. Generation of the band structure leads to differences in strength at the interfaces of the band structure and the development of fatigue cracks at these interfaces. The present invention can obtain excellent fatigue characteristics by making it difficult for fatigue cracks to develop since the generation of the band structure is suppressed.

The process for producing the maraging steel of the present invention comprises melting a steel of the aforementioned chemical composition, casting the molten steel to obtain a steel ingot, hot forging the steel ingot at a forging ratio of at least 4 for a forged piece, then conducting soaking treatment by keeping the forged piece one or more times in a temperature range of 1100–1280° C. for a total hot holding time of 10–100 hours, and then plastic working the forged piece.

According to this production process of the present invention, the steel is formed from the composition that makes it difficult for nonmetallic inclusions to develop, and the hot forging and the soaking treatment (component homogenization and diffusion annealing treatment) are performed under specific conditions. Therefore, the maraging steel can be manufactured easily with the Ti component and Mo component segregation ratios of 1.3 or less each and fewer nonmetallic inclusions. Implementation of this production process also does not require special equipment and provides good productivity because it is not necessary to carry out vacuum arc remelting.

The other maraging steel of the present invention is formed from a steel of the aforementioned chemical composition and contains a nonmetallic inclusion in its structure having a size of 30 $\mu$m or less when the size of the nonmetallic inclusion is expressed by the diameter of a corresponding circle when the circumferential length of the nonmetallic inclusion is taken the circumference of the corresponding circle.

This maraging steel makes it possible to limit the content of nonmetallic inclusions since the steel is formed from the composition that make it difficult for nonmetallic inclusions to develop. Making the size of the nonmetallic inclusion be 30 $\mu$m or less also makes it possible to obtain excellent fatigue characteristics by eliminating large nonmetallic inclusions that accelerate the expansion of fatigue cracks.

The Ti component segregation ratio and the Mo component segregation ratio in the aforementioned other maraging steel are preferably 1.3 or less each. This makes it possible to suppress the development of a band structure caused by segregation of the components and thereby to further improve the fatigue characteristics.

The process for the production of the other maraging steel of the present invention comprises melting a steel that has the aforementioned chemical composition, casting the molten steel to obtain a steel ingot with a taper Tp=(D1−D2)×100/H of 5.0–25.0%, a height-diameter ratio Rh=H/D of 1.0–3.0, and a flatness ratio B=W1/W2 of 1.5 or less, taking the diameter of a corresponding circle that has a circumference corresponding to the circumferential length of the top of the steel ingot as D1, the diameter of a corresponding circle with a circumference corresponding to the circumferential length of the bottom of the steel ingot as D2, the height of the steel ingot as H, the diameter of a corresponding circle having a circumference corresponding to the circumferential length of the steel ingot at a location of H/2 as D, and the length of the long side and length of the short side of the steel ingot at a location of H/2 as W1 and W2, respectively, and plastic working the steel ingot to make the size of a nonmetallic inclusion in the steel be 30 μm or less when the size of the nonmetallic inclusion is expressed by the diameter of a corresponding circle, taking the circumferential length of the nonmetallic inclusion to be the circumference of the corresponding circle.

This production process makes the large nonmetallic inclusions separate rapidly by floating from the inside to the top of the steel ingot during casting and makes only small nonmetallic inclusions remain inside the steel ingot. Thus the appropriate plastic working of the steel ingot makes it easy to make the nonmetallic inclusions in the steel be 30 μm or less. Therefore, the maraging steel with excellent fatigue characteristics can be manufactured easily without vacuum arc remelting.

In the aforementioned production process as well, preferably the steel ingot is hot forged at a forging ratio of at least 4 for a forged piece, then submitted to soaking treatment by keeping the forged piece one or more times in a temperature range of 1100–1280° C. for a total hot holding time of 10–100 hours, and then plastic working the forged piece to make the sizes of the nonmetallic inclusion in the forged piece be 30 μm or less. This process makes it possible to easily manufacture the maraging steel with the Ti and Mo component segregation ratios in the steel of 1.3 or less each.

BEST MODE FOR CARRYING OUT THE INVENTION

Figure 1:
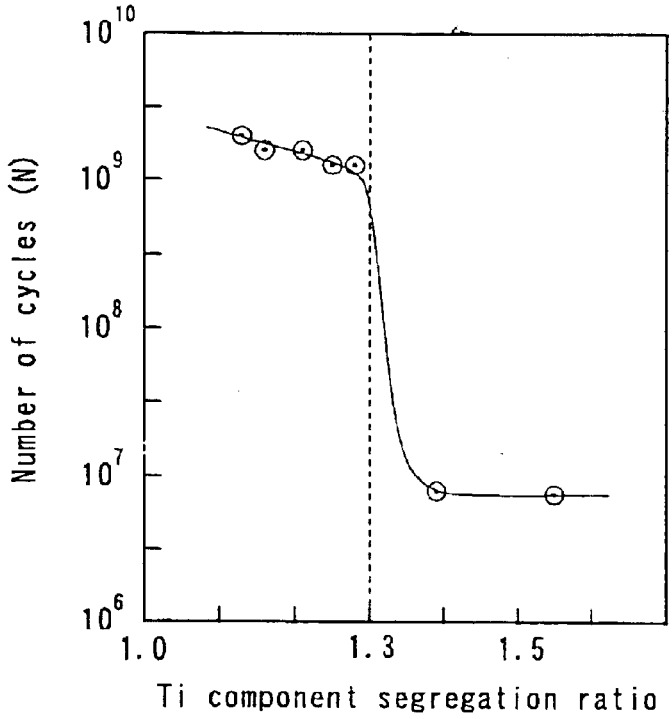
FIG. 1 is a graph that shows the relationship between the Ti component segregation ratio and the fatigue characteristics (number of cycles) of the maraging steel in the first practical example group.

The present inventors noted that it is Ti and Mo in the chemical composition of maraging steel that segregates most easily. They discovered that suppressing this segregation contributes to improving the fatigue characteristics. Specifically, when the segregation of components that develops during casting is not eliminated by hot working or heat treatment, a band structure develops and leads to differences in strength inside and outside the band structure after aging. The interfaces of the band structure then serve as the origin of fatigue cracks. Consequently, suppressing segregation of the components is effective for improving the fatigue life. The present inventors also discovered that improvement of the fatigue life solely by suppressing the number of nonmetallic inclusions is limited, but that it is effective to limit their size. The present invention was attained on the basis of these discoveries. The present invention is explained in detail below.

First of all, the chemical components of the maraging steel of the present invention will be explained. The maraging steel of the present invention has a chemical composition consisting essentially of, in % by weight:

C: 0.01% or less,

Ni: 8–19%,

Co: 8–20%,

Mo: 2–9%,

Ti: 0.1–2%,

Al: 0.15% or less,

N: 0.003% or less,

O: 0.0015% or less, and the balance Fe.

The reasons for the limits placed on the components of the maraging steel of the present invention are as follows.

C: 0.01% or less

The C level is preferably low because C forms carbides and lowers the fatigue strength by decreasing the amount of intermetallic compounds precipitated. The level in the present invention is 0.01% or less, preferably 0.005% or less.

Ni: 8–19%

Ni is an indispensable element for forming the tough matrix structure. The toughness deteriorates when there is less than 8%. On the other hand, addition of an excessive amount lowers the strength by producing austenite in addition to martensite in the matrix. Therefore, the lower limit of the Ni content range is 8%, preferably 12%, more preferably 16%, and the upper limit should be 19%.

Co: 8–20%

Co improves the strength by accelerating the precipitation of Mo-containing intermetallic compounds. The strength decreases when there is less than 8%. On the other hand, addition of more than 20% lowers the toughness. Therefore, the lower limit of the Co content range is 8% and the upper limit should be 20%, preferably 15%.

Mo: 2–9%

Mo is an effective element for strengthening the steel by precipitating $Fe_2Mo$ and $Ni_3Mo$ by aging. The strength becomes inadequate when the content is less than 2%. On the other hand, more than 9% increases microsegregation in the steel and reduces the toughness. Therefore, the lower limit of the Mo content range is set at 2%, preferably 3%, and the upper limit at 9%, preferably 6%.

Ti: 0.1–2%

Ti is an element that is effective for strengthening the steel in the same way as Mo by precipitating $Ni_3Ti$ and NiTi by aging. The strength is inadequate when its content is less than 0.1%. Therefore, the lower limit of the Ti content range is 0.1%, preferably 0.3%. On the other hand, the increase in microsegregation in the steel becomes conspicuous when the content exceeds 2%. This microsegregation reduces the toughness and fatigue strength. Moreover, the increase in Ti(C,N)-based nonmetallic inclusions deteriorates the durability. Therefore, the upper limit of the Ti content range is 2%, preferably 1.2%.

Al: 0.15% or less

Al is effective in deoxidation. However, alumina-based oxides increase and reduce the durability when there is more than 0.15%. Therefore, the upper limit is set at 0.15%.

N: 0.003% or less

N is a noxious element with harmful effects on the fatigue strength. Therefore, it is important to lower its level to 0.003% or less. TiN increases rapidly and further becomes a sequence of points to markedly lower the fatigue strength when the content exceeds 0.003%. The less N there is, the better for the fatigue strength. The durability is further improved by preferably keeping the content to 0.002% or less, more preferably 0.001% or less.

O: 0.0015% or less

It is important to keep the O level at 0.0015% or less because O forms oxide-based nonmetallic inclusions. More than 0.0015% markedly reduces the fatigue strength. The less O there is, the better for the fatigue strength. The durability is further improved by preferably keeping the level to 0.0010% or less.

The maraging steel of the present invention is composed essentially of the above components and the remainder Fe. However, this does not preclude the content of unavoidable impurities or the addition of other elements within the range that does not harm the effects of the aforementioned chemical components.

Both of the impurities Si and Mn lower the fatigue strength by forming nonmetallic inclusions such as $SiO_2$, MnO, and MnS. Therefore, the levels are preferably low, preferably to 0.05% or less and more preferably 0.02% or less, respectively. P and S also lower the fatigue strength by making the grain boundary brittle and forming nonmetallic inclusions. Therefore, the levels are preferably low, preferably 0.01% or less and 0.02% or less, respectively.

The microstructure of the maraging steel of the present invention will be explained next.

The maraging steel of the first embodiment of the present invention has a matrix made essentially of a martensite monophase and the Ti component segregation ratio and the Mo component segregation ratio in the structure of 1.3 or less each.

The Ti and Mo, especially Ti, among the chemical components segregate readily. When component segregation of Ti and Mo occurs in the steel ingot during casting of the molten steel, component segregation cannot be eliminated even by plastic working such as rolling or forging the steel ingot and a band structure develops based on the component segregation. When aging the maraging steel after plastic working, significant fluctuations in strength inside and outside the band structure are generated, and the interfaces of the band structure serve as the origin of fatigue rupture. Thus the fatigue strength decreases. In the case of a maraging steel plate in particular, the band structure becomes conspicuous and its negative effects are accentuated in thin plate of less than 0.5 mm. This decline in fatigue strength is accelerated rapidly when the component segregation ratios of Ti and Mo exceed 1.3 each, as is clear in the practical examples discussed below. Therefore, the upper limit of the component segregation ratios of Ti and Mo in the maraging steel of the present invention is 1.3 each, preferably 1.2 each. The smaller the segregation ratio is, the more the fatigue strength of the maraging steel improves.

The component segregation ratio of Ti and Mo in the present invention means the ratio of the maximum concentration to the minimum concentration (maximum concentration/minimum concentration) of Ti and Mo in the direction of thickness of the maraging steel. The shape of the maraging steel is not particularly limited. For example, various shapes are possible such as plates and pipes. Components other than Ti and Mo also segregate, but keeping the component segregation ratios of Ti and Mo that tend to conspicuous component segregation to the prescribed values also keeps other components such as Co within a nonproblematic range. Therefore, only the component segregation ratios of Ti and Mo are stipulated in the present invention.

The aforementioned maraging steel of the first embodiment is manufactured by melting a steel with the aforementioned chemical composition, preferably in a vacuum atmosphere, casting the molten steel for a steel ingot, hot forging the steel ingot obtained in this way at a forging ratio of at least 4, conducting soaking treatment by holding the forged ingot one or more times at a temperature range of 1100–1280° C. so that the total hot holding time is 10–100 hours, then conducting plastic working such as hot or cold rolling as necessary to obtain the desired plate thickness.

The forging ratio (cross-sectional area before forging/cross-sectional area after forging) in the hot forging is set at least 4, because the distance between the segregation peaks of Ti and Mo increases, and this prevents adequate flattening by diffusion, and makes it difficult to bring the component segregation ratios of Ti and Mo to 1.3 or less when the forging ratio is less than 4, even under optimum hot holding conditions. The prescribed Ti and Mo component segregation ratios also become impossible to obtain even with an appropriate forging ratio when the hot holding temperature in soaking treatment (sometimes referred to hereinafter as soaking temperature) is less than 1100° C. or the total hot holding time (sometimes referred to hereinafter as soaking time) is less than 10 hours. On the other hand, the crystals become conspicuously coarser, the grain size number falls below 8, and the fatigue strength decreases markedly when the soaking temperature exceeds 1280° C. or the soaking time exceeds 100 hours. Therefore, the lower limit of the soaking temperature is 1100° C., preferably 1180° C., and the upper limit is 1280° C., preferably 1250° C. The lower limit of the soaking time is set at 10 hours, preferably 20 hours, and the upper limit at 100 hours, preferably 72 hours. The Ti and Mo segregation ratios in the forged piece obtained after soaking treatment is scarcely changed and remain basically the same even by subsequent plastic working such as rolling.

This production process makes it possible to manufacture the maraging steel with few nonmetallic inclusions and Ti and Mo component segregation ratios of 1.3 or less easily without arc remelting. Therefore, special arc remelting equipment is not required during production of the maraging steel and the desired maraging steel can be produced easily by ordinary production equipment such as forging equipment and annealing furnaces, so the productivity is also good.

The maraging steel of the second embodiment of the present invention will be explained next. The explanation of the chemical composition of this maraging steel will be omitted because it is the same as in the aforementioned maraging steel of the first embodiment. Although the matrix of the structure of the maraging steel of the second embodiment is essentially made from a martensite monophase, the size of the nonmetallic inclusion contained in the structure is 30 μm or less. The size of the nonmetallic inclusion is the value expressed by the diameter of a corresponding circle, taking the circumferential length of the nonmetallic inclusion to be the circumference of the corresponding circle.

In the discussion concerning fatigue strength, the fatigue strength in steel materials such as carbon steel was believed to be the critical stress that generates fatigue cracks. However, the critical stress that stops the propagation of the cracks that have developed has been recognized recently rather than the crack-generating critical stress. The state in which propagation of cracks that have developed is stopped also includes cases in which the material contains defects such as these cracks, so one can infer that expansion of the originally produced defects themselves decides their own fatigue strength. Therefore, when the nonmetallic inclusion larger than the stopped crack (crack the propagation of which has stopped) is present under a load placed repeatedly on the material, the nonmetallic inclusion serves as the origin of propagating cracks, so the fatigue strength decreases. The fatigue strength drops rapidly in this case when the size of the nonmetallic inclusion in the structure exceeds 30 μm, as will be evident in the practical examples discussed below. Therefore, the upper limit of the size of the nonmetallic inclusion in the structure in the present invention is 30 μm, preferably 20 μm, more preferably 10 μm. In the case of working the maraging steel into plates in particular, the negative effects of the nonmetallic inclusion on the fatigue strength become especially conspicuous when the plate thickness is less than 0.5 mm. Therefore, the inclusion size is preferably 10 μm or less.

The Ti component segregation ratio and the Mo component segregation ratio in the maraging steel of the second embodiment as well are preferably 1.3 or less each, as in the aforementioned maraging steel of the first embodiment. This suppresses generation of a band structure and, together with restricting the size of the nonmetallic inclusion to 30 μm or less, makes it possible to further improve the fatigue strength. The smaller the segregation ratio is, the more effective the improvement of the fatigue strength.

The maraging steel of the second embodiment is produced by melting a steel of the aforementioned chemical composition, preferably in a vacuum atmosphere, casting the molten steel by a mold with the prescribed dimensional relationships, and conducting appropriate plastic working or soaking treatment combined with plastic working of the steel ingot that have the prescribed dimensional relationships obtained in this way.

Figure 9:
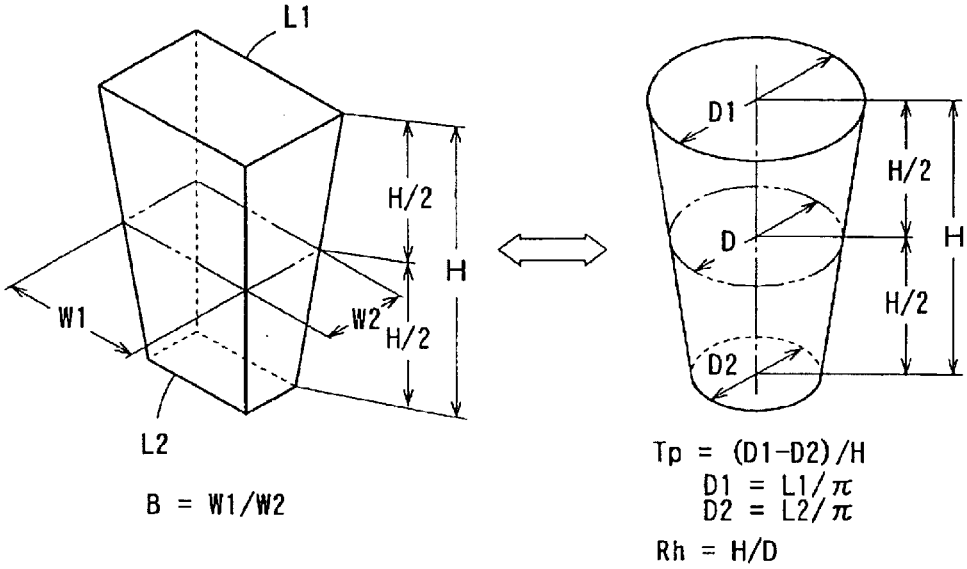
FIG. 9 is a perspective view of a steel ingot intended to explain a taper Tp, a height-diameter ratio Rh, and a flatness ratio B.

As shown in FIG. 9 in the steel ingot, when the diameter of a corresponding circle with a circumference corresponding to the circumferential length L1 of the top of the steel ingot is taken as D1, the diameter of a corresponding circle with a circumference corresponding to the circumferential length L2 of the bottom of the steel ingot is taken as D2, the height of the steel ingot is taken as H, the diameter of a corresponding circle with a circumference corresponding to the circumferential length of the steel ingot at a location of H/2 is taken as D, and the length of the long side and length of the short side of the steel ingot at a location of H/2 are taken as W1 and W2, respectively, a taper Tp=(D1−D2)×100/H is 5.0–25.0%, a height-diameter ratio Rh=H/D is 1.0–3.0, and a flatness ratio B=W1/W2 is 1.5 or less. The dimensions of the aforementioned steel ingot also stipulate the dimensions of the mold part of the mold. The reasons for selecting the taper Tp, the height-diameter ratio Rh, and the flatness ratio B as the dimensional parameters that define the steel ingot (mold) will be explained here.

The causes of heterogeneity of steel ingots that have major effects on maintenance of the quality and integrity of the products are based on changes in the physical and chemical properties of the steel during solidification of the steel ingots. Differences in factors such as solubility of the various elements, diffusion rate, density, and heat conductivity in liquid and solid steel create defects such as segregation of the various elements, shrinkage cavities, pipes, bubbles, and nonmetallic inclusions and cause heterogeneity of the steel ingots. Though sufficient smelting of the molten steel is generally fundamental for obtaining good-quality steel ingots, the molten steel solidification process must be regulated appropriately for the aforementioned reasons to obtain homogeneous ingots with few defects.

When the molten steel is poured into the mold, a chill layer that grows in unregulated directions is first formed with nucleuses produced on the mold walls as the origin, and a columnar crystal zone is formed thereafter. Since the columnar crystals grow as a result of the heat that flows into the mold, they grow basically perpendicular to the mold wall surface, i.e., in the direction opposite heat extraction. The nonmetallic inclusions are also pushed out in the direction of growth of the columnar crystals and float up to the top of the molten steel in the mold. Therefore, the mold taper (bilateral taper) Tp was used as a dimensional parameter that contributes to separation of the nonmetallic inclusions.

The balance between the lengthwise solidification rate and widthwise solidification rate in the mold as well is believed to be a factor that contributes to separation of the nonmetallic inclusions. Specifically, the molten steel must solidify successively upward from the bottom to separate the nonmetallic inclusions in the mold by floating them to the top. Therefore, the height-diameter ratio Rh that is related to the lengthwise solidification rate and the flatness ratio B that is associated with the widthwise solidification rate were also selected as dimensional parameters of the mold. The term length means the vertical direction of the steel ingot or mold and the term width means the horizontal direction.

As will be made clear in the practical examples discussed below, setting the taper Tp at at least 5.0%, preferably at least 10%, the height-diameter ratio Rh at 3.0 or less, preferably 2.5 or less, and the flatness ratio B at 1.5 or less, preferably 1.2 or less, causes the large nonmetallic inclusions to float rapidly from the interior of the mold to the top and makes so that only small nonmetallic inclusions remain inside the steel ingot. On the other hand, the taper becomes too large when Tp exceeds 25.0%. This causes hang tearing at the shoulder region of the steel ingot (a phenomenon that settling of the body of the ingot together with solidification-induced shrinkage is inhibited locally by the mold and the inhibited regions develop side cracks for being incapable of bearing the weight of the steel ingot below). Therefore, the upper limit of Tp is set at 25.0%, preferably 20%. Since shrinkage cavities develop inside the steel ingot when the height-diameter ratio Rh is less than 1.0, the lower limit of Rh is set at 1.0, preferably 1.5. Incidentally, conventional molds generally have a taper Tp of around 3%.

According to this production process, casting a molten steel of the prescribed chemical composition by a mold designed to cast the steel ingot with the aforementioned dimensional relationships without vacuum arc remelting and merely conducting appropriate plastic working of the steel ingot make it easy to make the sizes of the nonmetallic inclusions in the steel be 30 μm or less, preferably 20 μm or less, more preferably 10 μm or less.

Plastic working of the steel ingot includes hot forging and rolling (hot rolling or also cold rolling). As mentioned above, to make the component segregation ratios of Ti and Mo be 1.3 or less each, the steel ingot is preferably hot forged at a forging ratio of at least 4, and submitted to soaking treatment by holding them one or more times at a temperature of 1100–1280° C. for a total hot holding time of 10–100 hours, followed by plastic working such as rolling as necessary thereafter to obtain the desired plate thickness.

The present invention is explained in greater detail below through practical examples. However, this does not mean that the present invention is in any way limited by the following practical examples.

First Practical Example Group

Each of steel of the chemical components shown in Table 1 below was melted by vacuum induction melting. Each of molten steel was cast in a mold shaped as a rectangular solid (taper Tp=3%). The ingots obtained (1000 kgf each) were hot forged under the production conditions shown in Tables 2 and 3. After conducting soaking treatment as necessary, 0.3 mm thick plates were worked by hot and cold rolling. 100 mm long, 10 mm wide test pieces were taken from each thin plate along the direction of rolling. After solution heat treatment for 1 hour (holding time) at 820° C. (holding temperature) and aging for 4 hours at 480° C., $NH_3$ gas nitriding was carried out for 6 hours at 450° C. The total draft from the mean thickness of the steel ingots to the 0.3 mm thick plates was approximately 99.9% in this practical example group.

The Ti and Mo component segregation ratios were studied using samples obtained in this way. For the component segregation ratios, the maximum and minimum Ti and Mo concentrations were measured in the direction of thickness of each sample by line profile by EPMA and the ratio (maximum/minimum) was calculated. Since a nitride layer is present in the surface layer up to 30 μm from the surface of the sample, x-ray scanning was performed after removing the surface layer.

The cross-section along the direction of rolling (lengthwise direction) of each sample was also examined by optical microscope (400×) and the grain size number measured by the austenite grain size number test method for steel stipulated in JIS G-0511.

Figure 7:
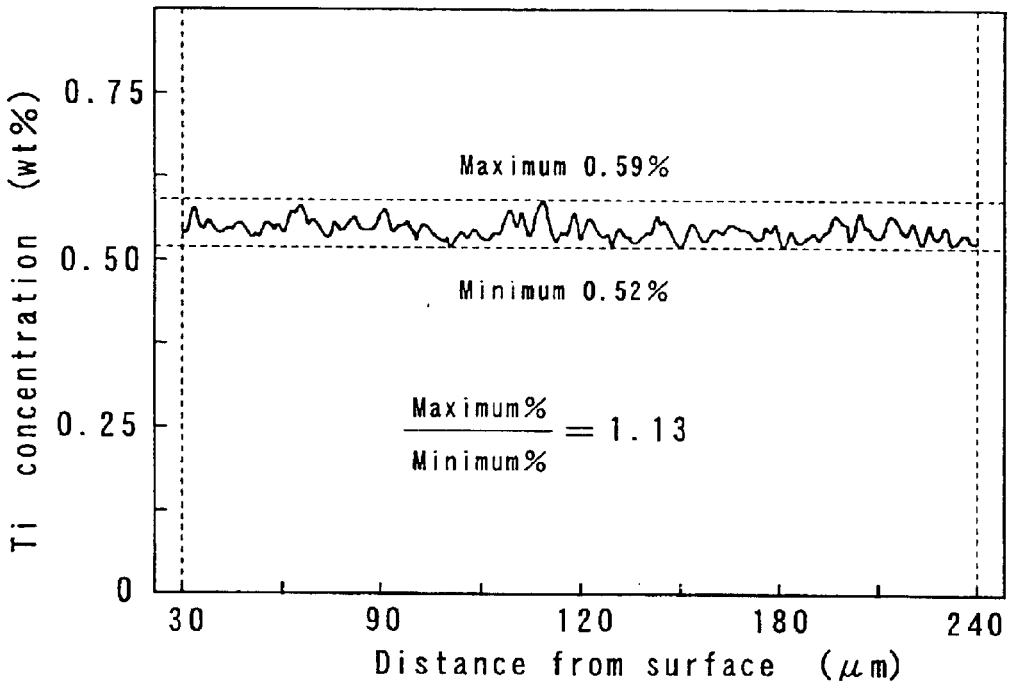
FIG. 7 is a graph that shows the Ti concentration distribution in the direction of plate thickness in a certain practical example of the first practical example group.
Figure 8:
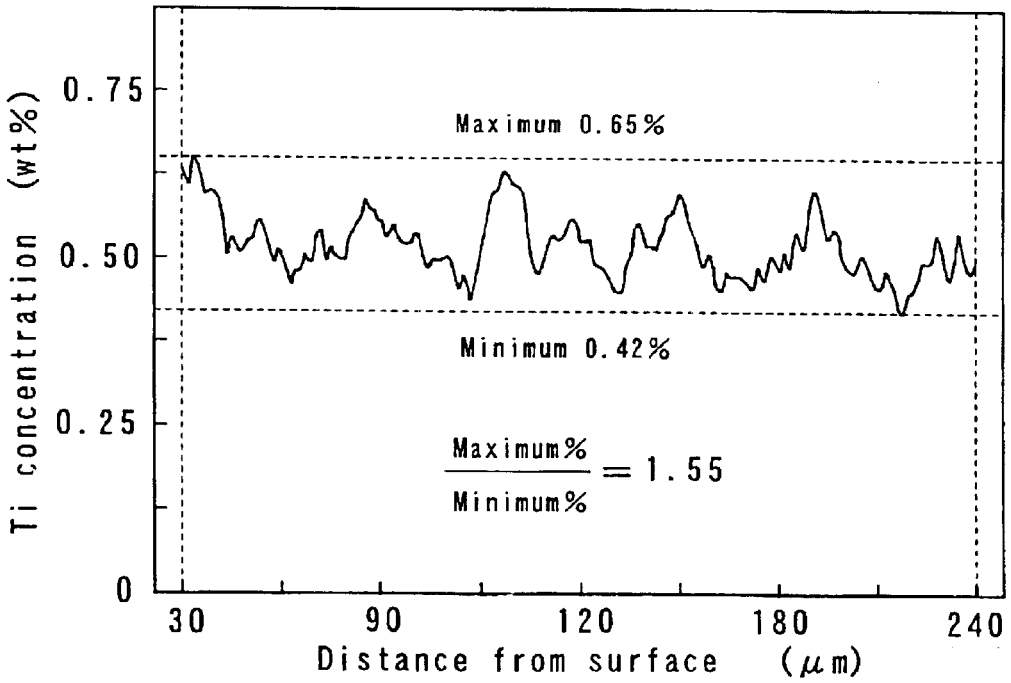
FIG. 8 is a graph that shows the Ti concentration distribution in the direction of plate thickness in a certain comparative example of the first practical example group.

The fatigue characteristics were also evaluated using each sample. In the evaluation of the fatigue characteristics, the fatigue was evaluated by placing the test piece cyclically under constant stress of 30 kgf/mm$^2$ and determining the number of cycles (N) until failure of the test piece. The results are shown in Tables 2 and 3. FIGS. 7 and 8 also show examples of the results of EPMA analysis of samples used to calculate the Ti component segregation ratio. FIG. 7 is a practical example (sample no. 27). FIG. 8 is a comparative example (sample no. 21).

TABLE 1

| Steel type | Chemical composition (mass %; balance: substantially Fe) | | | | | | | |
|---|---|---|---|---|---|---|---|---|
| No. | C | Ni | Co | Mo | Ti | Al | N | O |
| A | 0.003 | 15.3 | 18.7 | 2.2 | 1.93 | 0.06 | 0.0026 | 0.0011 |
| *B | 0.006 | 12.7 | 16.1 | 3.8 | 2.75 | 0.15 | 0.0005 | 0.0005 |
| C | 0.005 | 12.8 | 17.6 | 4.1 | 1.71 | 0.13 | 0.0022 | 0.0010 |
| *D | 0.005 | 9.1 | 18.5 | 4.2 | 2.51 | 0.07 | 0.0010 | 0.0014 |
| E | 0.008 | 18.8 | 8.2 | 3.4 | 0.55 | 0.15 | 0.0012 | 0.0012 |
| *F | 0.009 | 7.4 | 10.7 | 3.7 | 0.42 | 0.15 | 0.0009 | 0.0008 |
| G | 0.004 | 8.7 | 12.2 | 4.8 | 1.28 | 0.08 | 0.0019 | 0.0011 |
| *H | 0.008 | 17.6 | 23.4 | 3.5 | 0.13 | 0.12 | 0.0006 | 0.0009 |
| I | 0.001 | 15.8 | 15.4 | 8.4 | 0.83 | 0.07 | 0.0010 | 0.0005 |
| *J | 0.003 | 15.2 | 14.8 | 10.4 | 1.16 | 0.04 | 0.0010 | 0.0010 |

(Notes)
Underlined numbers designate values outside the scope of inventive components.
Asterisked steel types are comparative steel types.

TABLE 2

| Sample No. | Steel type No. | Forging ratio | Soaking conditions Temperature ° C. | Soaking conditions Time hr. | Ti component segregation ratio | Mo component segregation ratio | Grain size number | Number of cycles |
|---|---|---|---|---|---|---|---|---|
| *1 | A | 2.1 | 1100 | 10 | 1.66 | 1.41 | 9 | $7.9 \times 10^3$ |
| *2 | " | 3.3 | " | " | 1.44 | 1.36 | 10 | $8.5 \times 10^8$ |
| 3 | " | 4.2 | " | " | 1.28 | 1.25 | 10.5 | $1.1 \times 10^9$ |
| 4 | " | 5.5 | " | " | 1.15 | 1.13 | 10.5 | $1.2 \times 10^9$ |
| 5 | " | 7.2 | " | " | 1.08 | 1.05 | 11 | $1.3 \times 10^9$ |
| *6 | B | 6.8 | " | " | 1.73 | 1.56 | 11 | $5.6 \times 10^7$ |
| *11 | C | 4.0 | 1000 | 20 | 1.62 | 1.60 | 11 | $5.9 \times 10^8$ |
| *12 | " | " | 1050 | " | 1.59 | 1.56 | 11 | $6.4 \times 10^8$ |
| 13 | " | " | 1100 | " | 1.30 | 1.28 | 11 | $1.1 \times 10^9$ |
| 14 | " | " | 1150 | " | 1.28 | 1.26 | 10.5 | $1.1 \times 10^9$ |
| 15 | " | " | 1200 | " | 1.23 | 1.23 | 10.5 | $1.1 \times 10^8$ |
| 16 | " | " | 1250 | " | 1.20 | 1.20 | 9.5 | $1.1 \times 10^9$ |
| 17 | " | " | 1280 | " | 1.18 | 1.17 | 8 | $1.2 \times 10^9$ |
| *18 | " | " | 1300 | " | 1.18 | 1.15 | 7.5 | $7.1 \times 10^8$ |
| *19 | D | " | 1280 | " | 1.57 | 1.17 | 10 | $4.9 \times 10^7$ |
| *21 | E | 4.0 | 1000 | 72 | 1.55 | 1.50 | 10.5 | $8.8 \times 10^8$ |
| *22 | " | " | 1050 | " | 1.39 | 1.37 | 10.5 | $9.0 \times 10^8$ |
| 23 | " | " | 1100 | " | 1.28 | 1.25 | 10 | $1.1 \times 10^9$ |
| 24 | " | " | 1150 | " | 1.25 | 1.21 | 9.5 | $1.1 \times 10^9$ |

TABLE 2-continued

| Sample No. | Steel type No. | Forging ratio | Soaking conditions Temperature ° C. | Soaking conditions Time hr. | Ti component segregation ratio | Mo component segregation ratio | Grain size number | Number of cycles |
|---|---|---|---|---|---|---|---|---|
| 25 | " | " | 1200 | " | 1.21 | 1.18 | 9 | $1.2 \times 10^9$ |
| 26 | " | " | 1250 | " | 1.16 | 1.12 | 8.5 | $1.2 \times 10^9$ |
| 27 | " | " | 1280 | " | 1.13 | 1.10 | 8 | $1.3 \times 10^9$ |
| *28 | " | " | 1300 | " | 1.12 | 1.10 | 7.5 | $1.3 \times 10^7$ |
| *29 | F | " | 1200 | " | 1.07 | 1.06 | 9 | $2.4 \times 10^7$ |

(Notes)
Asterisked samples nos. are comparative examples.

TABLE 3

| Sample No. | Steel type No. | Forging ratio | Soaking conditions Temperature ° C. | Soaking conditions Time hr. | Ti component segregation ratio | Mo component segregation ratio | Grain size number | Number of cycles |
|---|---|---|---|---|---|---|---|---|
| *31 | G | 4.0 | 1100 | 0 | 1.57 | 1.55 | 11 | $8.5 \times 10^6$ |
| *32 | " | " | " | 5 | 1.37 | 1.35 | 11 | $1.5 \times 10^7$ |
| 33 | " | " | " | 10 | 1.29 | 1.26 | 10.5 | $1.2 \times 10^9$ |
| 34 | " | " | " | 24 | 1.27 | 1.25 | 10 | $1.2 \times 10^9$ |
| 35 | " | " | " | 48 | 1.26 | 1.23 | 9 | $1.1 \times 10^9$ |
| 36 | " | " | " | 72 | 1.26 | 1.22 | 8.5 | $1.1 \times 10^9$ |
| *37 | " | " | " | 100 | 1.07 | 1.06 | 9.5 | $6.4 \times 10^7$ |
| *41 | " | 4.0 | 1280 | 5 | 1.36 | 1.42 | 10 | $8.2 \times 10^8$ |
| 42 | " | " | " | 10 | 1.26 | 1.30 | 9.5 | $1.3 \times 10^8$ |
| 43 | " | " | " | 24 | 1.23 | 1.24 | 9.5 | $1.2 \times 10^9$ |
| 44 | " | " | " | 48 | 1.19 | 1.21 | 9 | $1.1 \times 10^9$ |
| 45 | " | " | " | 72 | 1.11 | 1.15 | 8.5 | $1.1 \times 10^9$ |
| 46 | " | " | " | 100 | 1.07 | 1.10 | 8 | $1.1 \times 10^9$ |
| *47 | " | " | " | 120 | 1.07 | 1.10 | 7.5 | $7.6 \times 10^8$ |
| *48 | " | " | " | 48 | 1.24 | 1.31 | 8.5 | $5.3 \times 10^8$ |

(Notes)
Asterisked samples nos. are comparative examples.

Tables 2 and 3 show that the fatigue characteristics are excellent in the practical examples that all gave a number of cycles of $1\times10^9$ or more. FIG. 1 shows a graph of the relationship between the Ti component segregation ratio and number of cycles of the fatigue test for samples nos. 21–27. This shows that the fatigue characteristics improve rapidly when the Ti component segregation ratio is 1.3 or less. Mo shows a similar tendency.

Figure 2:
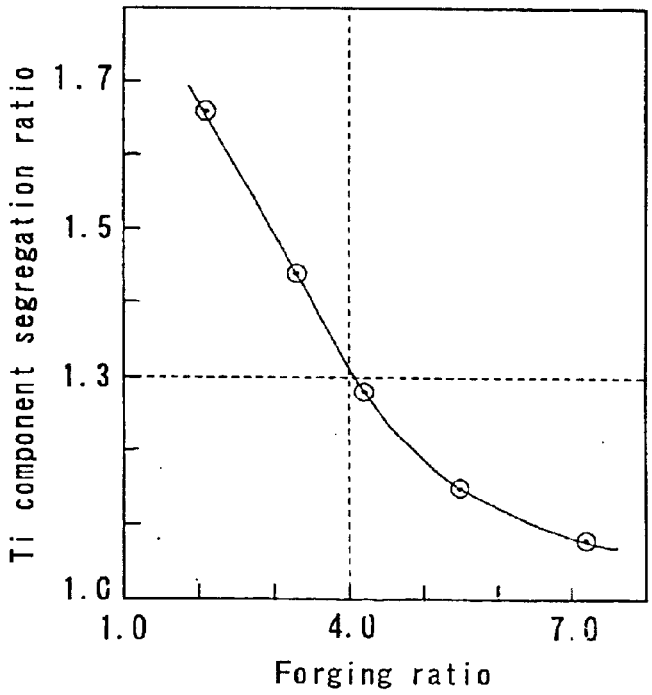
FIG. 2 is a graph that shows the relationship between the forging ratio and the Ti component segregation ratio of the maraging steel in the first practical example group.

FIG. 2 shows a graph of the relationship between the forging ratio and Ti component segregation ratio for samples 1–5 that employed steel type A with components that satisfy the chemical components of the present invention (components of the present invention) that were submitted to soaking treatment for 10 hours at 1100° C. after hot forging. This shows that the Ti component segregation ratio decreases as the forging ratio increases and that the Ti component segregation ratio falls below 1.3 when the forging ratio reaches at least 4. The same is also true of Mo.

Figure 3:
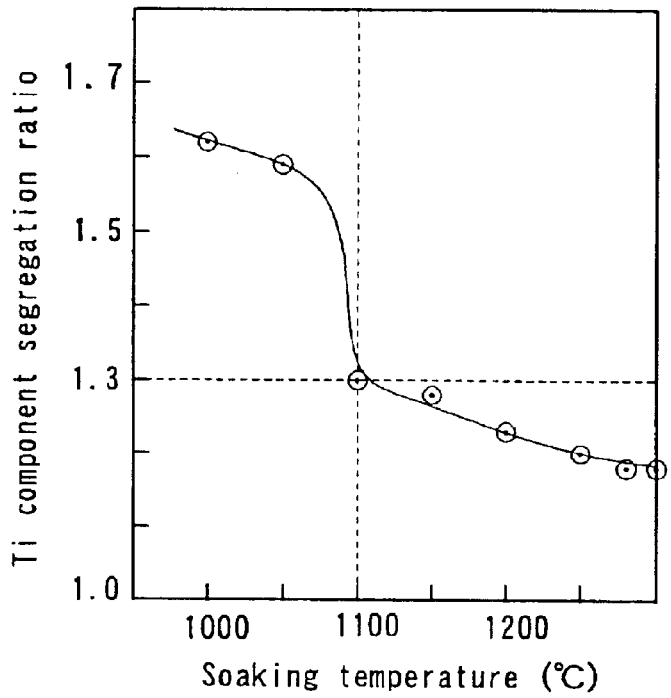
FIG. 3 is a graph that shows the relationship between the soaking temperature and the Ti component segregation ratio of the maraging steel in the first practical example group.

FIG. 3 shows a graph of the relationship between the soaking temperature and Ti component segregation ratio for samples nos. 11–18 that employed steel type C which uses components of the present invention and was submitted soaking treatment at various soaking temperatures with a hot holding time of 20 hours after hot forging at a forging ratio of 4. This shows that the Ti component segregation ratio decreases as the soaking temperature increases and that the Ti component segregation ratio falls below 1.3 when the soaking temperature is at least 1100° C. The same is also true of Mo.

Figure 4:
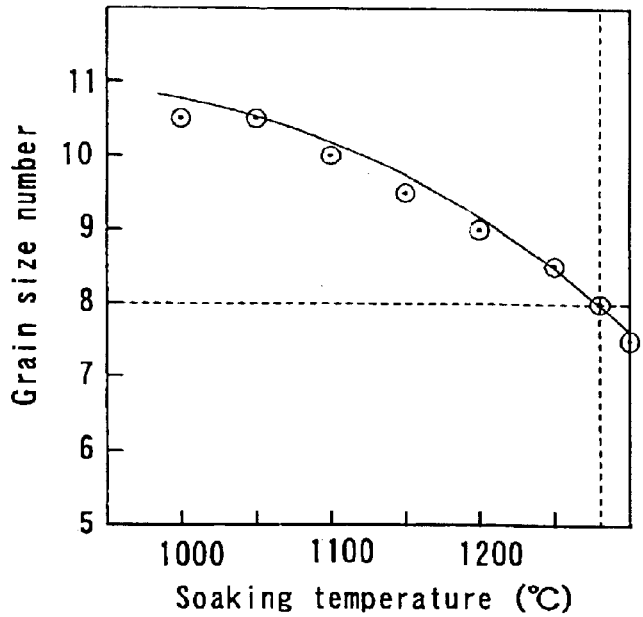
FIG. 4 is a graph that shows the relationship between the soaking temperature and the grain size number of the maraging steel in the first practical example group.

FIG. 4 shows a graph of the relationship between the soaking temperature and grain size number for samples nos. 21–28 that employed steel type E which uses components of the present invention and was similarly submitted to soaking treatment at various soaking temperatures with a soaking time of 72 hours and a forging ratio of 4. This shows that the grain size number decreases (i.e., the crystals become coarser) as the soaking temperature increases and that the grain size number becomes less than 8 when the soaking temperature exceeds 1280° C. As is evident from sample no. 28, the fatigue strength drops markedly when the grain size number falls below 8. Samples nos. 21 and 22 have good grain, but appropriate Ti and Mo component segregation ratios are not obtained due to the low soaking temperature.

Figure 5:
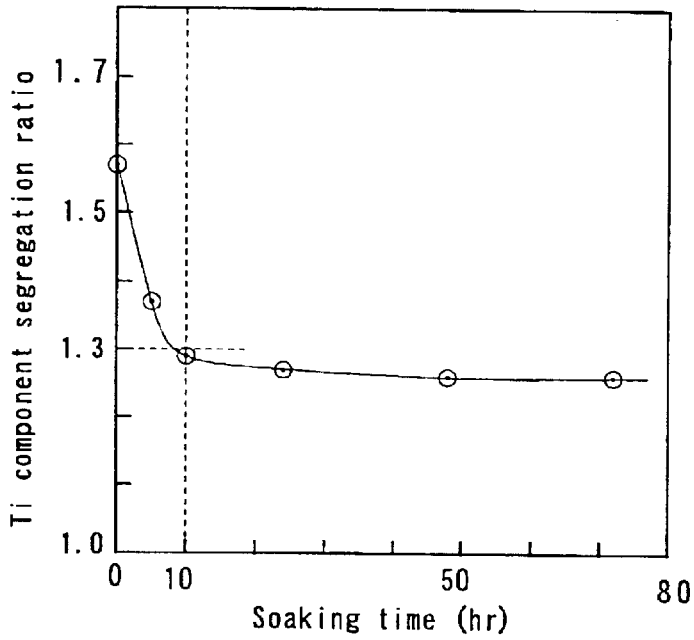
FIG. 5 is a graph that shows the relationship between the soaking time and the Ti component segregation ratio of the maraging steel in the first practical example group.

FIG. 5 shows a graph of the relationship between the soaking time and Ti component segregation ratio of samples nos. 31–36 that employed steel type G which uses the components of the present invention and was submitted to soaking treatment for various soaking times at a soaking temperature of 1100° C. after hot forging at a forging ratio of 4. This shows that the Ti component segregation ratio decreases as the soaking time increases and that the Ti component segregation ratio falls below 1.3 when the soaking time is at least 10 hours. The same is also true of Mo.

Figure 6:
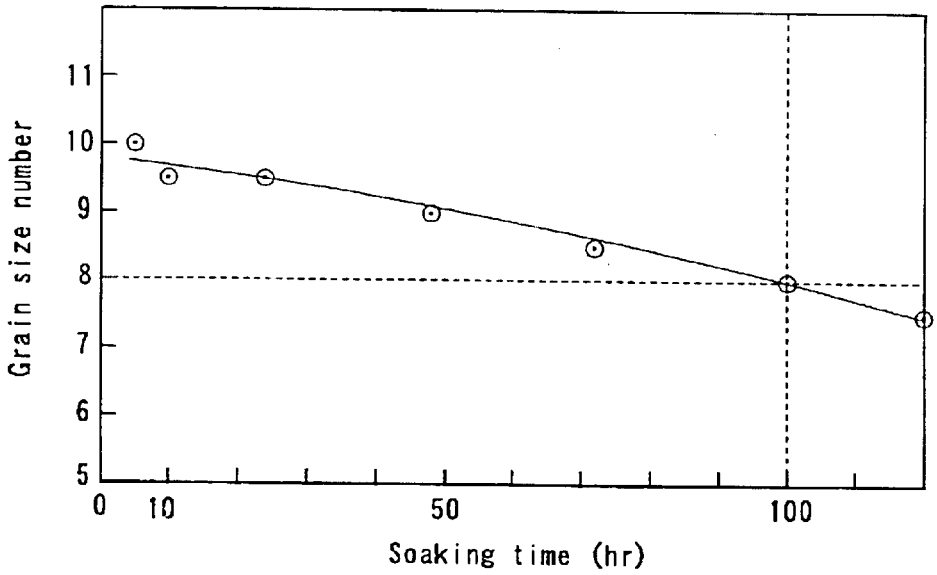
FIG. 6 is a graph that shows the relationship between the soaking time and the grain size number of the maraging steel in the first practical example group.

FIG. 6 shows a graph of the relationship between the soaking time and grain size for samples nos. 41–47 that employed steel type I which uses the components of the present invention and was submitted to soaking for various soaking times at a soaking temperature of 1280° C. with a forging ratio of 4. This shows that the grain size number decreases as the soaking time increases and that the grain size number falls below 8 when the soaking time exceeds 100 hours. The marked decrease in fatigue strength is evident in sample no. 47.

Second Practical Example Group

Each molten steel, obtained by melting each steel of the chemical compositions shown in Table 11 below (all components of the present invention) by vacuum induction melting, was poured into various molds that had been prepared so as to obtain steel ingots with the taper Tp, the height-diameter ratio Rh, and the flatness ratio B shown in Tables 12 and 13. The steel ingots (500 kgf each) obtained were hot forged at the forging ratios shown in the same tables. After soaking treatment as necessary, 0.3 mm thick plates were worked by hot and cold rolling. Test pieces were taken from each thin plate along the direction of rolling and submitted to solution heat treatment, aging, and $NH_3$ gas nitriding under the same conditions as in the aforementioned first practical example group. The total draft from the mean thickness of the steel ingots to the 0.3 mm thin plates was approximately 99.9% in this practical example group as well.

TABLE 11

| Steel type | Chemical composition (wt %; balance: substantially Fe) | | | | | | | | Strength level |
|---|---|---|---|---|---|---|---|---|---|
| No. | C | Ni | Co | Mo | Ti | Al | N | O | kgf/mm$^2$ |
| A | 0.005 | 13.3 | 14.7 | 2.4 | 0.2 | 0.08 | 0.0028 | 0.0013 | 150 class |
| B | 0.003 | 17.8 | 8.9 | 4.8 | 0.4 | 0.12 | 0.0017 | 0.0006 | 200 class |
| C | 0.008 | 17.6 | 12.3 | 3.8 | 1.7 | 0.10 | 0.0015 | 0.0005 | 230 class |
| D | 0.006 | 8.2 | 18.3 | 9.0 | 0.8 | 0.05 | 0.0021 | 0.0008 | 270 class |

The size of the nonmetallic inclusion and the Ti and Mo component segregation ratios were studied using the samples obtained in this way. The size of the nonmetallic inclusion was studied by examining the fracture surface of each fatigue test piece by SEM (scanning electron microscope), defining the nonmetallic inclusion that caused cracks, and determining the diameter of a corresponding circle, taking the circumferential length of the nonmetallic inclusion as the circumference of the corresponding circle, as the size of the nonmetallic inclusion. The component segregation ratio was determined in the same way as in the aforementioned first practical example group.

Figure 10:
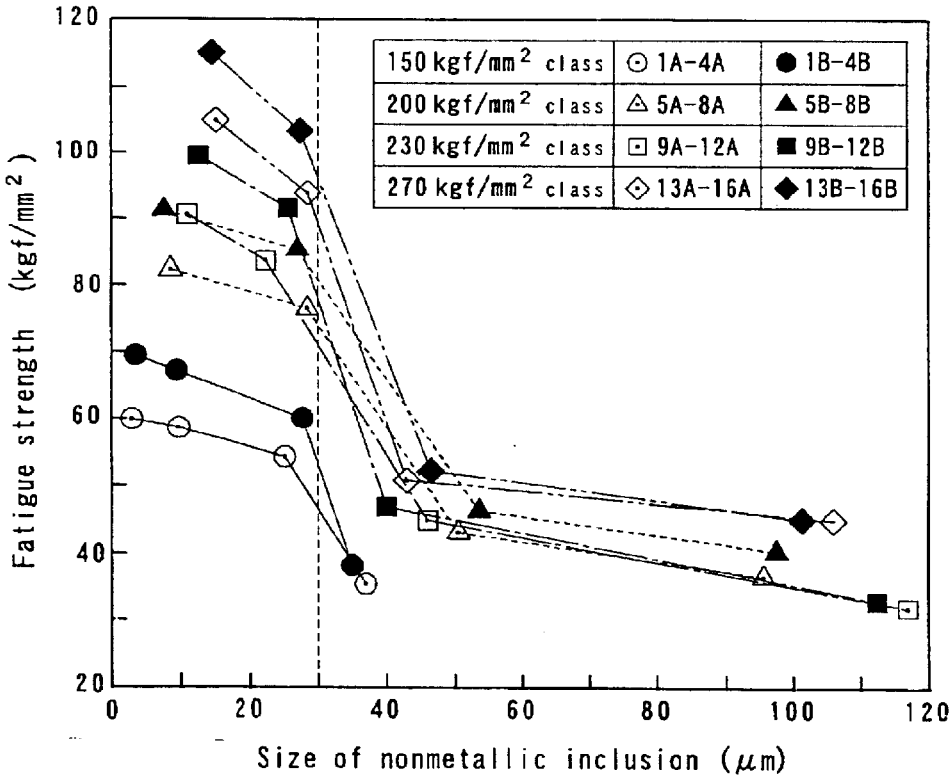
FIG. 10 is a graph that shows the relationship between the size of the nonmetallic inclusion and the fatigue strength of the maraging steel in the second practical example group.

The fatigue characteristics were also studied using each sample. The fatigue strength was evaluated by the maximum stress on the boundary that did not cause failure even after $10^7$ repeated stress. The results are shown in Tables 12 and 13. The tables also show series A samples with high component segregation ratios (those with A appended to the sample number) and series B samples with low component segregation ratios (those with B appended to the sample number). FIG. 10 shows a graph of the relationship between the size of the nonmetallic inclusions and the fatigue strength. In Tables 12 and 13, ① is practical examples with a nonmetallic inclusion size of 30 μm or less and ② is practical examples with a nonmetallic inclusion size of 30 μm or less and Ti and Mo component segregation ratios of 1.3 or less. The others are comparative examples.

TABLE 12

| | Steel ingot conditions | | | | | Soaking conditions | | | Ti | Mo | | |
|---|---|---|---|---|---|---|---|---|---|---|---|---|
| Sample No. | Ingot No. | Taper Tp % | Height-diameter ration Rh | Flatness ratio B | Forging ratio | Temperature ° C. | Time hr. | Size of inclusion μm | component segregation ratio | component segregation ratio | Fatigue strength kgf/mm$^2$ | Remarks |
| 1A | A | 17.6 | 1.9 | 1.2 | 3.5 | 1050 | 10 | 3.2 | 1.52 | 1.40 | 60.1 | ① |
| 1B | " | " | " | " | 6.5 | 1230 | 72 | 3.5 | 1.28 | 1.25 | 69.7 | ② |
| 2A | " | 11.1 | 2.5 | 1.0 | 3.5 | 1050 | 10 | 9.8 | 1.46 | 1.37 | 58.8 | ① |
| 2B | " | " | " | " | 4.6 | 1280 | 48 | 9.4 | 1.2 | 1.13 | 67.3 | ② |
| 3A | " | 5.5 | 2.5 | 1.0 | 3.5 | 1050 | 10 | 25.2 | 1.42 | 1.36 | 54.4 | ① |
| 3B | " | " | " | " | 5.3 | 1230 | 96 | 27.8 | 1.13 | 1.10 | 60.2 | ② |
| 4A | " | 3.7 | 2.8 | 1.7 | 3.5 | 1050 | 10 | 37.2 | 1.43 | 1.35 | 35.4 | |
| 4B | " | " | " | " | 7.2 | 1180 | 96 | 35.0 | 1.10 | 1.05 | 38.2 | |
| 5A | B | 8.3 | 1.8 | 1.5 | 2.8 | — | — | 28.4 | 1.49 | 1.40 | 76.5 | ① |
| 5B | " | " | " | " | 5.5 | 1200 | 48 | 27.1 | 1.27 | 1.22 | 85.3 | ② |
| 6A | " | 14.7 | 1.9 | 1.1 | 2.8 | — | — | 8.6 | 1.56 | 1.53 | 82.5 | ① |
| 6B | " | " | " | " | 4.5 | 1200 | 48 | 7.7 | 1.30 | 1.26 | 91.2 | ② |
| 7A | " | 5.8 | 3.3 | 2.0 | 2.8 | — | — | 50.5 | 1.42 | 1.38 | 43.2 | |
| 7B | " | " | " | " | 3.0 | 1200 | 48 | 53.4 | 1.36 | 1.25 | 46.4 | |
| 8A | " | 1.5 | 3.4 | 1.4 | 2.8 | — | — | 95.6 | 1.41 | 1.36 | 36.7 | |
| 8B | " | " | " | " | 7.5 | 1280 | 96 | 97.6 | 1.07 | 1.03 | 40.3 | |

TABLE 13

| Sample No. | Ingot No. | Steel ingot conditions: Taper Tp % | Height-diameter ration Rh | Flatness ratio B | Forging ratio | Soaking conditions: Temperature ° C. | Time hr. | Size of inclusion μm | Ti component segregation ratio | Mo component segregation ratio | Fatigue strength kgf/mm² | Remarks |
|---|---|---|---|---|---|---|---|---|---|---|---|---|
| 9A | C | 9.3 | 2.3 | 1.3 | 3.0 | 1100 | 24 | 22.3 | 1.55 | 1.52 | 83.8 | 1 |
| 9B | " | " | " | " | 6.8 | 1150 | 72 | 25.6 | 1.26 | 1.23 | 91.8 | 2 |
| 10A | " | 14.7 | 2.8 | 1.3 | 3.0 | 1100 | 24 | 11.1 | 1.6 | 1.55 | 90.6 | 1 |
| 10B | " | " | " | " | 6.8 | 1180 | 72 | 12.5 | 1.26 | 1.25 | 99.6 | 2 |
| 11A | " | 9.0 | 1.5 | 1.8 | 3.0 | 1100 | 24 | 45.8 | 1.52 | 1.48 | 45.2 | |
| 11B | " | " | " | " | 6.8 | 1230 | 72 | 40.0 | 1.27 | 1.22 | 47.0 | |
| 12A | " | 10.4 | 4.1 | 1.4 | 3.0 | 1100 | 24 | 117.0 | 1.58 | 1.50 | 32.1 | |
| 12B | " | " | " | " | 6.8 | 1200 | 72 | 112.4 | 1.29 | 1.26 | 33.1 | |
| 13A | D | 7.5 | 3.0 | 1.5 | 2.5 | 1230 | 5 | 28.5 | 1.40 | 1.33 | 94.0 | 1 |
| 13B | " | " | " | " | 4.8 | 1230 | 96 | 27.3 | 1.11 | 1.10 | 103.3 | 2 |
| 14A | " | 17.5 | 1.7 | 1.4 | 2.5 | 1230 | 5 | 15.2 | 1.45 | 1.40 | 105.2 | 1 |
| 14B | " | " | " | " | 4.8 | 1230 | 48 | 14.4 | 1.26 | 1.23 | 115.1 | 2 |
| 15A | " | 3.2 | 2.1 | 1.2 | 2.5 | 1230 | 5 | 42.7 | 1.38 | 1.37 | 51.2 | |
| 15B | " | " | " | " | 4.8 | 1230 | 72 | 46.5 | 1.19 | 1.16 | 52.4 | |
| 16A | " | 2.7 | 3.8 | 2.3 | 2.5 | 1230 | 5 | 106.4 | 1.35 | 1.35 | 44.8 | |
| 16B | " | " | " | " | 4.8 | 1230 | 96 | 101.2 | 1.10 | 1.10 | 45.1 | |

Tables 12 and 13 and FIG. 10 show that the fatigue strength improves markedly below the boundary when 30 μm is taken as the boundary of nonmetallic inclusion size and that excellent fatigue strength is obtained in the practical examples. Series B samples with low component segregation ratios and nonmetallic inclusions in the range below 30 μm further improve fatigue strength.

INDUSTRIAL APPLICABILITY

The maraging steel and process for the production thereof of the present invention can be utilized as a material and process for the production thereof for various types of steel parts that require properties such as toughness, strength, weldability, and dimensional stability to heat treatment in addition to fatigue strength.

What is claimed is:

1. A maraging steel plate with a thickness less than 0.5 mm. and comprising:

a chemical composition consisting essentially of, in % by weight:

C: 0.01% or less,

Ni: 8–19%,

Co: 8–20%,

Mo: 2–9%,

Ti: 0.1–2%,

Al: 0.15% or less,

N: 0.003% or less,

O: 0.0015% or less, and the balance Fe; and the Ti component segregation ratio and the Mo component segregation ratio in its structure of 1.3 or less each.

2. A maraging steel plate with a thickness less than 0.5 mm. and comprising:

a chemical composition consisting essentially of, in % by weight:

C: 0.01% or less,

Ni: 8–19%,

Co: 8–20%,

Mo: 2–9%,

Ti: 0.1–2%,

Al: 0.15% or less,

N: 0.003% or less,

O: 0.0015% or less, and the balance Fe; and a nonmetallic inclusion having a size of 30 μm or less when the size of the nonmetallic inclusion is expressed by the diameter of a corresponding circle taking the circumferential length of the nonmetallic inclusion to be the circumference of the corresponding circle, wherein the Ti component segregation ratio and the Mo component segregation ratio in its structure is 1.3 or less each.

* * * * *